United States Patent [19]

Brennan

[11] Patent Number: 4,527,348

[45] Date of Patent: Jul. 9, 1985

[54] GUN BARREL

[75] Inventor: Dean C. Brennan, Whitefish, Mont.

[73] Assignee: D. C. Brennan Firearms, Inc., Kalispell, Mont.

[21] Appl. No.: 574,658

[22] Filed: Jan. 27, 1984

[51] Int. Cl.[3] ..... F41C 21/00

[52] U.S. Cl. ..... 42/76 R; 42/78; 89/14.05

[58] Field of Search ..... 42/78, 76 R, 79; 89/14 R

[56] References Cited

U.S. PATENT DOCUMENTS

| | | | |
|---|---|---|---|
| 157,008 | 11/1874 | Kerr | 42/76 R |
| 315,746 | 4/1885 | De Arguibel | 42/78 |
| 460,102 | 10/1891 | Carver | 42/78 |
| 804,483 | 11/1905 | Lincoln | 42/78 |
| 1,290,840 | 1/1919 | Maynard | 42/76 R |
| 1,355,222 | 10/1920 | Pedersen | 42/78 |
| 1,355,421 | 10/1920 | Pedersen | 42/78 |
| 1,777,771 | 10/1930 | Scherf | 42/78 |
| 2,345,089 | 3/1944 | Born | 42/76 R |
| 3,138,991 | 6/1964 | Malter | 42/76 R |
| 3,525,172 | 8/1970 | A'Costa | 42/78 |
| 4,126,955 | 11/1978 | Coffield | 42/78 |

FOREIGN PATENT DOCUMENTS

| | | |
|---|---|---|
| 143403 | 8/1950 | Australia . |
| 349103 | 5/1905 | France . |
| 353197 | 10/1937 | Italy . |
| 444914 | 2/1949 | Italy . |
| 627304 | 9/1978 | U.S.S.R. . |

OTHER PUBLICATIONS

"*Big Bertha*" *Bombards Paris*, by Jean Hallade (origin and date of publication presently unknown).

*Primary Examiner*—Charles T. Jordan
*Assistant Examiner*—Ted L. Parr
*Attorney, Agent, or Firm*—Brumbaugh, Graves, Donohue & Raymond

[57] ABSTRACT

A gun barrel adapted to be connected to a receiver includes a rifled portion and a smoothbore portion. The rifled portion may have deeper than normal grooves to permit the escape of propellant gases past the bullet. The smoothbore portion includes an increased diameter expansion section, a reduced diameter compression section and an alignment section. Gases expanding past the bullet reduce the peak pressure in the gun barrel and provide a relatively low pressure adjacent the muzzle at the time of bullet exit. The improved gun barrel affords increased bullet velocity and accuracy, and reduced felt recoil.

10 Claims, 8 Drawing Figures

27 X002 BARREL FEDERAL BOX 180 GRAIN V=2654 DASHED LINE # 27
41 STANDARD BARREL FEDERAL BOX 180 GRAIN V=2661 SOLID LINE # 41
ACTUAL PRESSURE ON PROJECTILE IN X002 BARREL DOTTED LINE

#23 X002 BARREL FEDERAL BOX 180 GRAIN V=2631 DASHED LINE #23
#39 STANDARD BARREL FEDERAL BOX 180 GRAIN V=2627 SOLID LINE #39

#32 X002 BARREL HANDLOAD 57.0 IMR 4350 CCI 250 PRIMER 180 GRAIN SP. V=2712 DASHED LINE #32

#35 STANDARD BARREL HANDLOAD 57.0 IMR 4350 CCI 250 PRIMER 180 GRAIN SP. V=2722 SOLID LINE #35

#14 X002 BARREL HANDLOAD 59.0 IMR 4350 CCI 250 PRIMER 180 GRAIN SP. V=2759 DOTTED DASHED LINE #14

GUN BARREL

BACKGROUND OF THE INVENTION

Gun tubes are rifled to impart spin to the projectile. The projectile is thereby stabilized and accuracy is enormously improved. Historically, smoothbore guns have given higher velocities, as the frictional drag between projectile and bore is reduced. Rifled barrels including smoothbore sections have been proposed from time to time and used successfully. The most dramatic example was the World War I Paris gun, a German development, which developed an astonishing range of 120 km by virtue of a muzzle velocity of 5260 fps. Seventeen meters of the tube was rifled; the last six meters was smoothbore at exactly the same diameter of the bottom surface of the rifling (i.e., groove diameter).

U.S. Pat. No. 3,525,172 teaches a method of duplicating the rifling form of the Paris gun, alleging that a smoothbore section of a diameter not less than the groove diameter following a rifled section improves velocity, especially when the transition from rifled to smooth barrel is placed at the point in the barrel where the peak pressure occurs (allegedly either 10.75 or 11.5 inches). However, in usual small arms design, the peak pressure occurs only a few bore diameters from the breech (approximately 0.75–1.5 inches).

In World War II, the Germans developed the tapered bore anti-tank gun, 7.5 cm 5.5 cm Pak 41. The bore tapered from 7.5 cm at the breech to 5.5 cm at the muzzle but the taper was not constant. The first part of the bore is cylindrical and rifled, the second, conical and unrifled and the third, measuring 27.6 inches in length, is cylindrical and unrifled. This gun utilized a Gerlich designed projectile that had a compressible outer case.

Another recent patent of interest, U.S. Pat. No. 4,126,955 for High Velocity Tapered Bore Gun and Ammunition, describes a gun barrel having a rifled section from which extends a smoothbore section tapering to a smaller diameter than the rifled section for reforming the projectile. With that structure, the projectile is reformed into a conical shape as it passes through the tapered section with, according to the '955 patent, beneficial results.

The combination of smooth and rifled barrels has been taught for years. U.S. Pat. No. 460,102 (1891) has a smooth section following the rifled section in a similar mode to the Paris gun and patents '955 and '172. Still another prior art patent, Australian Pat. No. 143,403, describes a rifled section followed by a larger diameter smoothbore section. This gun barrel functions as a dual purpose firearm to fire either bullets or cartridges loaded with shot. Russian Pat. No. 627,304 also discloses what appears to be an improvement over the Australian dual purpose gun barrel. It includes a rifled section followed by smoothbore sections which are used to expand the shot diametrically and cause it to lose some of the rotational moment it acquired in the rifled portion of the bore. Thus the smoothbore sections are provided to affect the shot, not the bullet.

It has been found that the prior art combination rifled and smoothbore guns have not significantly improved performance over conventional rifled barrels, and the designs have not been widely adopted or used.

SUMMARY OF THE INVENTION

The present invention is directed to a gun barrel formed with several sections cooperating with the propellant gases and bullet to provide safer operation, increased muzzle velocity, improved accuracy and less felt recoil.

More particularly, a gun barrel is formed with a breech section suitably bored to receive a cartridge. A rifled section, which may be conventionally designed, extends for a distance that imparts sufficient rotation to the bullet. It may sometimes be desirable to provide deeper than normal grooves in the rifled section, to permit propellant gases to escape past the bullet.

Extending from the rifled section is an expansion chamber of increased diameter to permit additional propellant gases to expand past the bullet, thereby providing much more rapid acceleration of the gases than the bullet. The expansion chamber functions to create a layer of compressed gases around the bullet that decreases friction ordinarily resulting from contact between the bullet and bore. In addition, the gases expanding past and ahead of the bullet evacuate the atmosphere in the bore to decrease frontal pressure on the bullet as it travels through the gun barrel in a jet of gases.

A compression section of the gun barrel extends from the expansion chamber with a decreased diameter. The final diameter of this section is less than the bullet diameter and greater than the bore of the rifled section.

Extending from the compression chamber is an alignment section having a diameter less than bullet caliber but greater than the land diameter (bore diameter). The bullet is aligned in this section to improve accuracy.

At the muzzle of the gun is located an expansion section having a depth and diameter determined by the volume of propellants. This section permits gases to be released past the bullet, as in the expansion section of the barrel. This occurs at the point where the bullet is exiting the alignment section.

Optimally, the overall length of the gun barrel from breech to muzzle, together with the unique structure of the barrel, utilizes the total burning of the propellant used. It provides a lower peak pressure in the barrel, a relatively low pressure at the muzzle and lower muzzle blast, in contrast to the high muzzle pressure of conventional barrels, and has a different pressure-time trace than a conventional gun. Thus safer gun operation is provided, as well as reduced bullet deformation and muzzle blast to improve accuracy and lessen felt recoil.

These and further features and advantages of the invention will be more readily understood when the following description is read in connection with the accompanying drawings.

DESCRIPTION OF EXEMPLARY EMBODIMENTS

Figure 1:
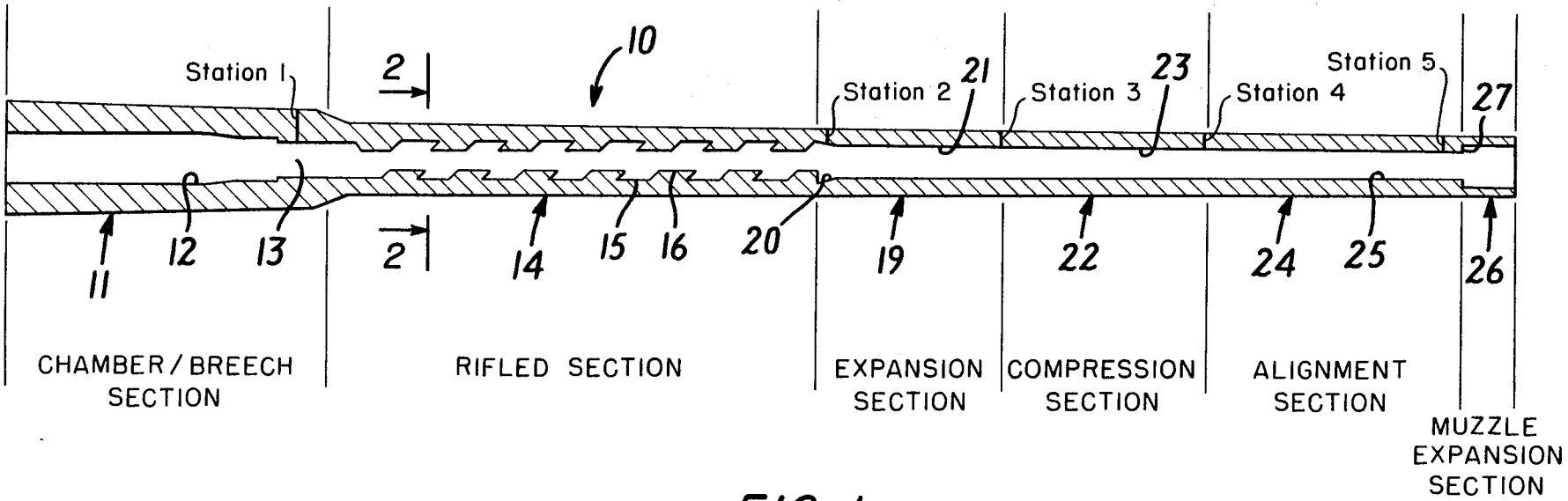
FIG. 1 is a view in cross section of a gun barrel, illustrated diagrammatically, constructed in accordance with the present invention.

Referring to the invention in greater detail with reference to FIG. 1, the exemplary gun barrel, having an overall length of 22 inches, includes a breech section 11 formed by a cartridge chamber 12 and a throat 13. Note that the drawing omits background detail and that the differences in diameter of the several barrel sections have been exaggerated on the drawing, in the interests of clarity in describing the invention. Typical dimensions of the inventive gun barrel have been set forth below. The barrel is adapted to be joined in a conventional manner to a suitable action or receiver. An exemplary cartridge for use in the breech is a 30-06 cartridge loaded with a 180 grain spire point projectile with overall cartridge length of approximately 3.25 inches.

Figure 2:
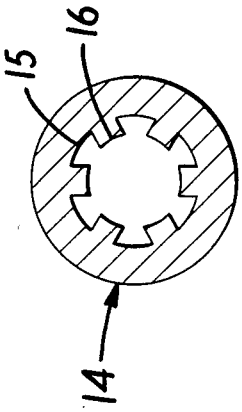
FIG. 2 is a cross sectional view of the gun barrel of FIG. 1 taken along the view line 2—2 looking in the direction of the arrows.

A rifled section 14 extends from the breech area 11 for a length sufficient to impart proper rotation to the bullet. For example, a length of about 6.75 inches has been used with the above-identified cartridge with good results. In the exemplary gun barrel, a 1 to 7.5 rifling twist was used, i.e., the bullet would turn once when traveling through a 7.5 inch long rifled section. As shown in FIG. 2, six grooves 15 have been used, with a groove diameter of 0.312 inch, which is slightly larger than the bullet diameter (0.308). The bore diameter or lands 16 have a dimension the same as a conventional gun barrel, typically 0.300 inch. This arrangement, herein designated relief groove rifling, results in a deeper than normal rifling depth due to larger than normal expansion grooves.

Good results have also been obtained by using relief groove rifling for every other groove. Thus, one half of the grooves have a normal diameter of 0.308 inch and the alternate grooves have a relief groove diameter greater than 0.308 inch, for example 0.315 inch.

The larger expansion or relief groove diameter is for the purpose of permitting propellant gases to expand past the bullet in the rifled portion. Thus, pressure is relieved and the atmosphere ahead of the bullet is evacuated. The propellant gases set up a layer between the bullet and bore, traveling approximately eight times faster than the bullet. This phenomenon in the inventive gun barrel not only prevents abnormal bullet deformation or expansion, but also increases bullet velocity due to the forward drag forces exerted by the gas. This form of gas expansion results in the greatest possible useful thrust upon the surface of a bullet.

An expansion section 19 having a length of 2.625 inches in this example initiates the smoothbore portion of the gun barrel. It includes a cylindrical portion 20 about 0.375 inch in length ending in a 60 degree taper going from 0.312 to 0.308 inch leading to the constant diameter portion 21. Note that this short cylindrical tapered section may be either inwardly or outwardly tapered, depending upon rifling depth and diameter of expansion section, or it can be omitted, for example, when the groove diameter and the expansion section diameter are the same. Most importantly, this tapered section lowers gas pressure markedly in the barrel and changes the expansion ratio in the barrel. As is known in the art, the expansion ratio equals case volume plus bore volume divided by case volume.

The expansion section diameter preferably is slightly larger than (up to 0.350 inch has proven satisfactory) or about equal or very slightly less than (for example 0.307 inch) that of the projectile, 0.308 inch for the bullet referred to above. To understand the function of this section, it must be recalled that the propellant gases expand and thereby move the bullet. The expansion section allows the gases to continue their expansion past the bullet, an expansion initiated in the rifled section, and accelerate much more rapidly than the bullet can travel.

Of significance is the increased forward drag forces on the total surface of the bullet in the expansion section as the gases escape past the bullet. A layer of compressed gas forms around the bullet and eliminates friction due to contact between bullet and bore, thus allowing an increased bullet velocity and reduced bullet deformation caused by bore contact. Moreover, increased evacuation of the atmosphere in the bore ahead of the projectile reduces frontal pressure on the bullet as it travels through the gun barrel in a jet of rushing gas and exits the bore into an atmosphere which is moving in the direction of bullet travel.

The bullet and gases exit the expansion section 19 and enter the decreased diameter compression section 22. The decreased diameter is preferably achieved by tapering at the bore 23 over about 4 inches to a diameter less than the bullet caliber, typically 0.305 inch for a 30-cal. bullet. The gas flow increases in velocity with reduced pressure as it passes through the compression section. However, some gases still flow past the bullet through the rifling grooves, which have been previously engraved in the bullet, to provide a continued forward drag. This, together with the pressure behind the bullet, causes continued acceleration of the bullet as it passes through the compression section. Also gas expansion past the bullet through the grooves continues removal of the atmosphere from the barrel.

An alignment section 24, extending from the compression section 22 for a distance of about 5 inches, is provided with a bore 25 having a typical diameter of 0.305 inch, which is less than bullet caliber, but greater than the bore diameter 16 of 0.300 inch. The section 24 functions to align the bullet on a constant rotational axis to insure the greatest possible accuracy. The geometry of the final inches of the bore 25 adjacent the muzzle is critical since it contributes importantly to gun accuracy.

As the bullet exits the alignment section, the pressure and muzzle blast is markedly lower than the corresponding pressure and muzzle blast in a conventional barrel, as will be evident from the pressure-time curves discussed hereinafter. This contributes to lessened bullet deformation and muzzle blast, resulting in increased accuracy and reduced felt recoil.

A muzzle crown 26 of increased diameter is provided at the gun barrel muzzle. The crown protects the critical shoulder 27 at the end of the bore 25 from impact and damage. It also permits propellant gases to be released past the bullet so that it exits into a controlled gas flow moving in the bullet direction.

The optimum overall length of the gun barrel from the breech to the muzzle is sufficient to utilize the gases generated by complete burning of the propellant used. Thus optimally its measurement depends upon the propellant and the projectile type and weight, but the length is not critical.

Referring next to test data obtained by firing tests of the inventive gun barrel and a comparable standard gun barrel, with reference to the pressure-time curves shown in FIGS. 3–8, these curves were made by obtaining signals from Kistler 607 C3 transducers placed in holes drilled and tapped in stations 1–5 of FIG. 1, station 5 being located one inch from the muzzles (shoulder 27 in FIG. 1) of the gun barrels. The transducer signals were coupled to Kistler 5004 Dual Mode Charge Amplifiers and then fed into a Tektronix 5110 Oscilloscope which consisted of two Tektronix 5A15N Amplifiers set at 5 volts per division and a 5B10N Time Base Amplifier with a setting of 0.2 ms per division. Data was recorded by a Polaroid C5C camera using ultra high speed instrument recording Land Pack Film #612, ASA 20,000. Bullet velocities were measured by an Oehler Chronograph Model No. 33, with sensors 10 feet apart, the first one being 10 feet from the gun muzzle.

Figure 3:
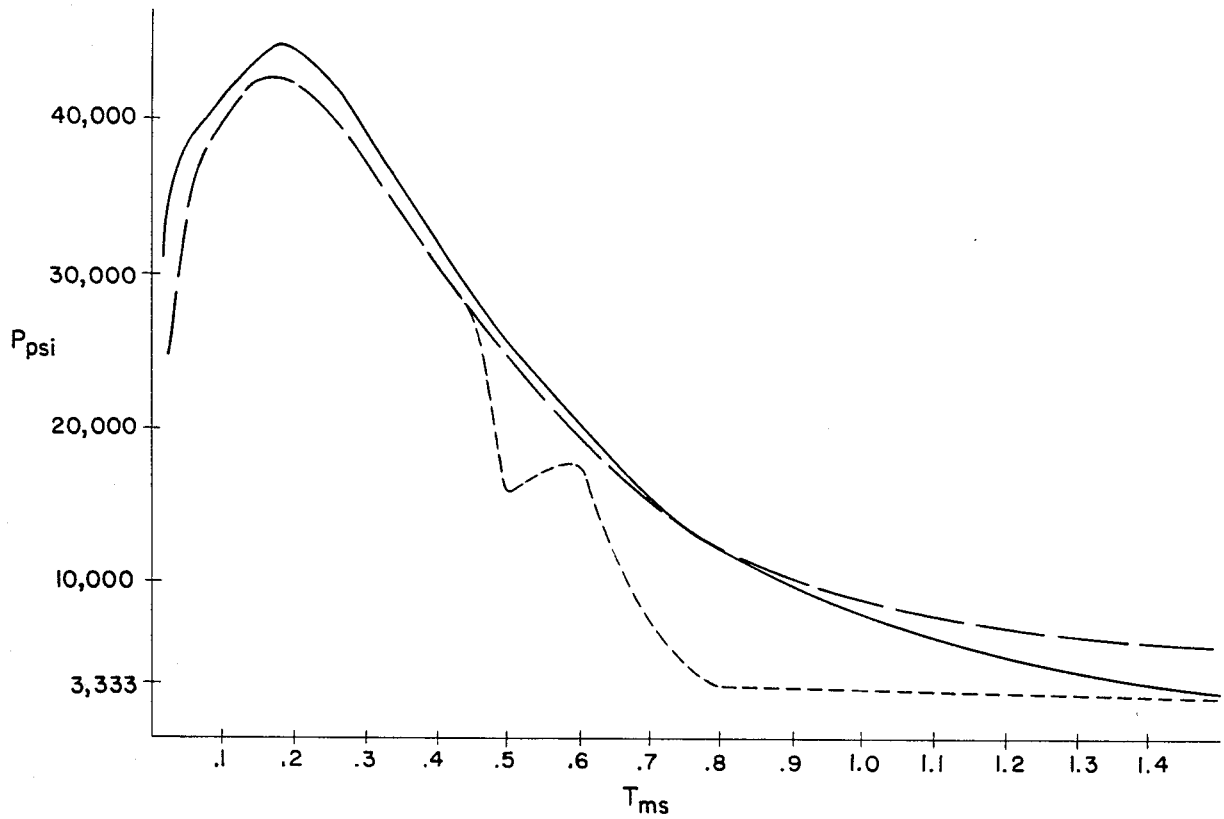
FIG. 3 is a graph showing pressure-time curves at the throats of the inventive gun barrel and a conventional gun barrel using factory ammunition, and a curve showing average actual pressure over time on the projectile as it travels down the inventive gun barrel, taken from five transducer positions.

One of the inventive gun barrels, designated X002, and a standard rifle gun barrel were each fired six times using 30-06 Federal Box 180 grain spire point bullets, Lot No. 21A-2307. Pressure-time curves were obtained from stations 1 and 5 and representative curves compared in FIGS. 3, 4 and 5, 6. In FIG. 3, the peak pressure of the inventive barrel was approximately 95% of the peak pressure in the standard barrel. The bullet velocities were essentially the same, the X002 barrel at 2654 fps (feet per second) vs. the standard barrel velocity of 2,661 fps.

Figure 5:
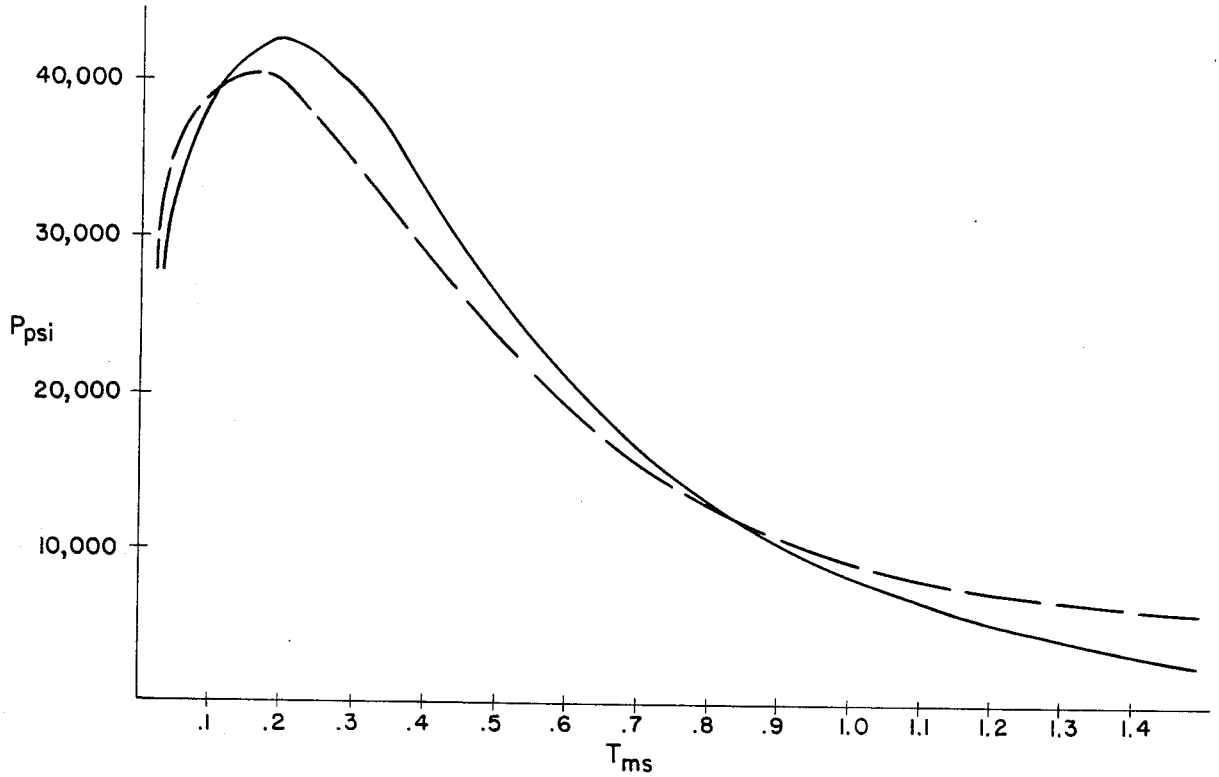
FIG. 5 are additional pressure-time curves at the throats of the inventive gun barrel and a conventional gun barrel using factory ammunition.

The same results are evident in the curves of FIG. 5. At similar bullet velocities, X002 barrel at 2631 fps and the standard barrel at 2627 fps, the inventive barrel showed a peak pressure of approximately 95% of the peak pressure in the standard barrel. It follows that the inventive gun barrel is safer to use since it achieves the same velocities with lower peak pressures.

The dotted line in FIG. 3 shows the average actual pressure over time on the projectile in the X002 barrel. The average actual pressure curve was obtained from measurements taken sequentially at stations 1 through 5, as the bullet traversed the barrel. As shown, the actual pressure is approximately equal to the peak pressure (dashed line curve) from the time the bullet is fired until about 0.45 ms, whereafter the actual pressure drops off.

Figure 4:
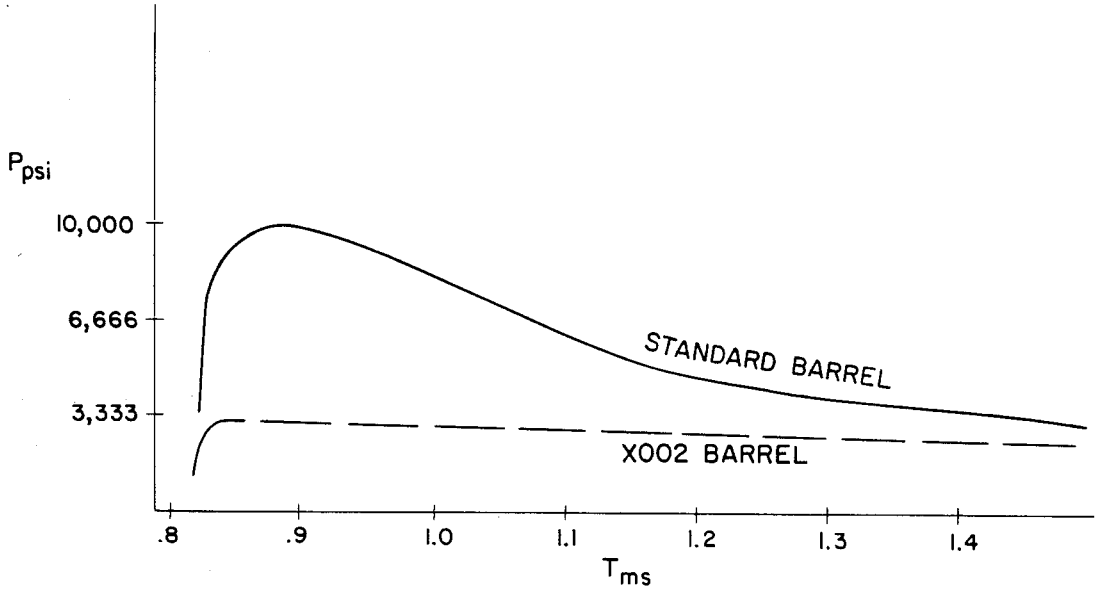
FIG. 4 are pressure-time curves at a point one inch from the muzzles of the inventive gun barrel and a conventional gun barrel.
Figure 6:
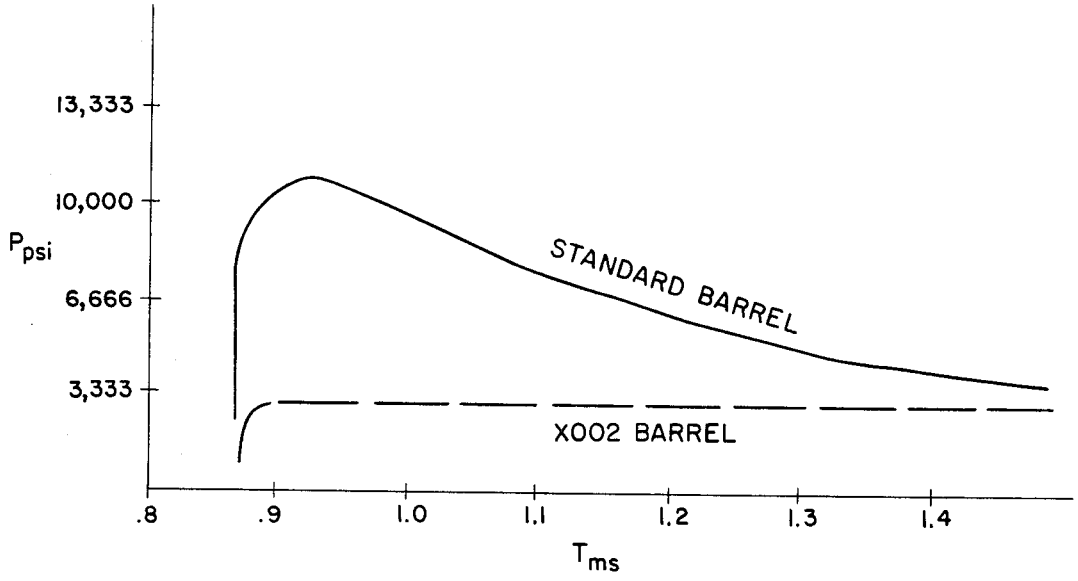
FIG. 6 are pressure-time curves at a point one inch from the muzzles of the inventive gun barrel and conventional gun barrel.

FIGS. 4 and 6 are pressure-time curves taken at station 5 for the firings shown in FIGS. 3 and 5. In the standard barrel the pressures recorded when the bullet reached station 5 are about 10,000 psi, approximately the same pressures recorded at the same point in time (0.9 ms) at station 1 for the throat pressure.

Referring to FIGS. 4 and 6, the strikingly dissimilar pressure-time curves there shown for the inventive X002 barrel illuminate the differences between the inventive gun barrel and a standard barrel. In the inventive gun barrel, the muzzle pressure is only about 3300 psi for the factory loads and remained constant at about that value during the relevant period initiated at the time of bullet arrival at station 5.

The greatly reduced pressure adjacent the muzzle of the inventive barrel provides significant advantages. The lower pressure causes substantially less damage or deformation of the bullet than does the higher pressure found in a standard barrel, a pressure about three times that of the inventive barrel adjacent the muzzle. It also produces less muzzle blast to affect the bullet exiting from the inventive barrel. Both of these factors contribute to the improved accuracy of bullets fired from the inventive barrel and the reduced felt recoil of the gun.

In standard rifled gun barrels, the bullet velocity closely tracks peak pressure, hence increasing the peak pressure increases bullet velocity. An unexpected benefit obtained with the inventive gun barrel is a bullet velocity substantially the same as that found in a standard gun barrel using the same loads, but with substantially lowered peak pressure. These results are due to the relief grooves in the rifled section permitting gases to expand past the bullet to provide forward drag on the bullet, and the use of those escaping gases to evacuate the atmosphere ahead of the bullet.

Figure 7:
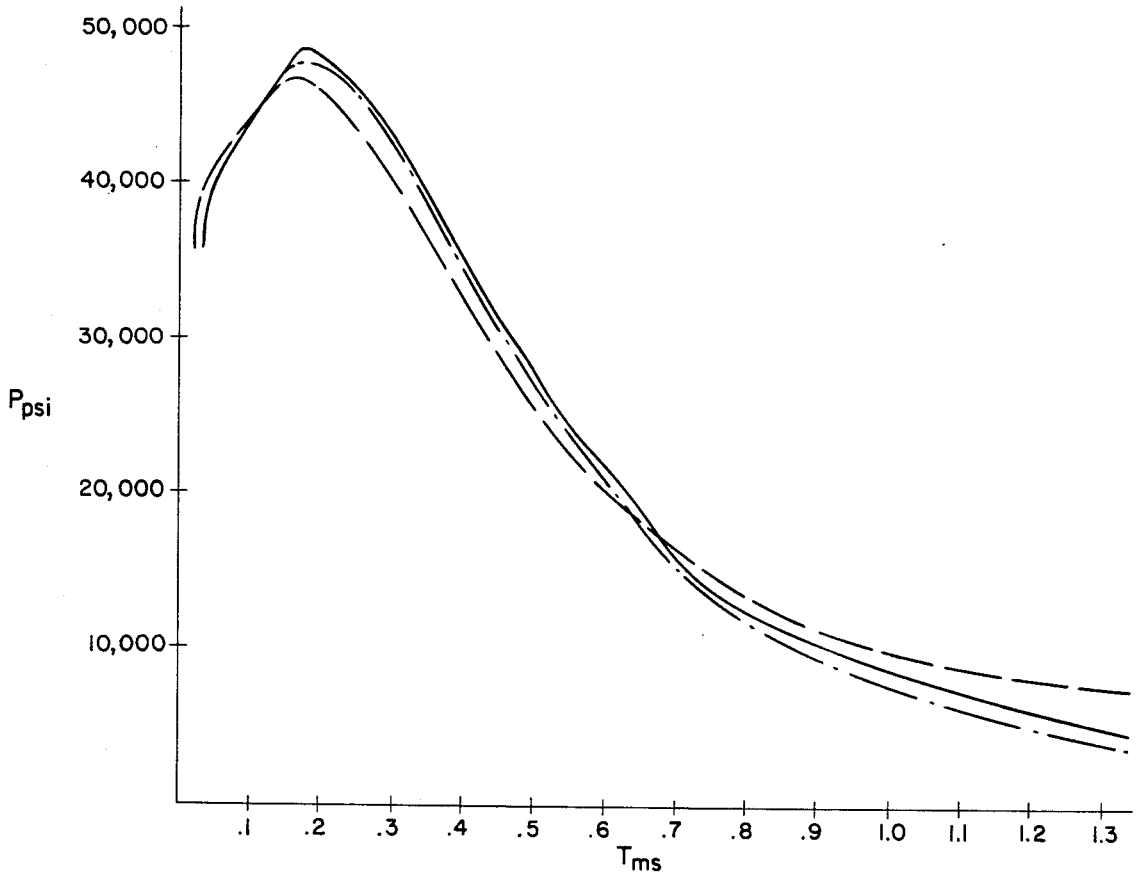
FIG. 7 are pressure-time curves at the throats of the inventive gun barrel and a conventional gun barrel, using maximum loads as recommended in reloading manuals and greater than maximum recommended loads in the inventive gun barrel.
Figure 8:
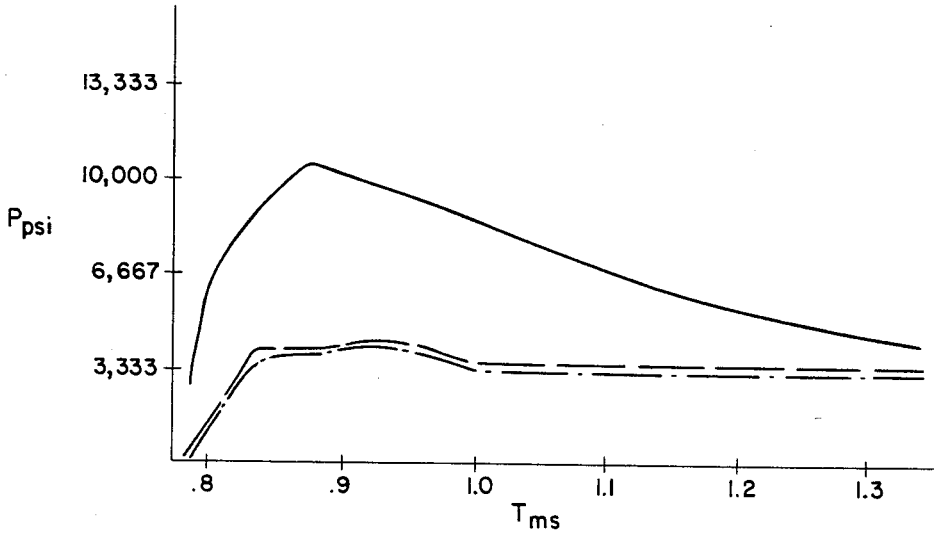
FIG. 8 are pressure-time curves at a point one inch from muzzles of the inventive gun barrel and a standard gun barrel utilizing the loads referred to in FIG. 7.

Tests were also conducted with selected hand loads resulting in representative pressure-time curves shown in FIGS. 7 and 8. After experimenting with maximum loads obtained from reloading manuals, 57 grains of DuPont IMR 4350 was selected as a very efficient load for the standard gun barrel. DuPont lists pressure from this load at 49,700 psi. The solid line curve of FIGS. 7 and 8, taken from stations 1 and 5, respectively, approximates this peak pressure in the standard gun barrel. With 57 grains of IMR 4350, CCI 250 primer, 180 grain Hornady spire point bullet, Federal Brass, firing six shots in both the inventive X002 barrel and the standard barrel, velocities averaged 2716 fps in the X002 barrel and 2730 fps in the standard barrel. In comparing the curves, at similar velocities the peak pressure in the X002 barrel was approximately 96% of the peak pressure in the standard barrel.

The third curve shown in FIG. 7 resulted from an attempt to match the peak pressure in the inventive X002 barrel with the higher peak pressure in the standard barrel previously discussed. A load of 59 grains of DuPont IMR 4350 was used, this being two grains over the recommended maximum. Average velocity for five shots was 2806 fps. One of the slower rounds was selected to find a trace that would match as closely as possible the trace for the standard barrel of 57 grains. As shown the peak pressure for the X002 barrel was approximately 98% of the standard barrel's peak pressure. Velocity equalled 2,759 fps. This data shows that the inventive barrel can achieve a higher velocity (1.36%) at a slightly lower peak pressure (98%).

The pressure-time curves shown in FIG. 8 illustrate the marked differences between the inventive gun barrel and a standard gun barrel. In the standard barrel, the pressure adjacent the muzzle, when the bullet reached station 5, was about 10,000 psi which closely corresponded with the throat pressure at station 1 at the same point in time. However, in the X002 barrel, the muzzle pressure was slightly above 3,300 psi at station 5 for the hand loads and remained constant at about that pressure, while the corresponding throat pressure was just under 10,000 psi at that same point in time.

Note that the X002 barrel from which the data was obtained to provide the curves of FIGS. 3–8 used dimensions on the tight side of the range of dimensions specified for the inventive barrel. Thus, gas escaped past the bullet in the cylindrical tapered section 20, having a diameter of 0.312 inch. Some gas also escaped only through the grooves in the engraved bullet in the remaining smoothbore sections 19, 22 and 24. However, other tests have provided good results with an expansion section 19 having an increased diameter of, for example, 0.350 inch. With that dimension, an increased amount of gases expands past the bullet, and provides a boundary layer between the bullet and bore in an increased length of the barrel, thereby further reducing friction in the smoothbore portion of the barrel.

As explained above, the gun barrel 10 produces a different and improved pressure profile, and there is increased bullet velocity for the same peak pressures with, however, less felt recoil due to venting of part of the propellant gases prior to bullet exit. Thus the recoil time starts when the propellant gases first expand past the bullet and ends at final gas ejection through the gun muzzle. (The elapsed time when the recoil is generated is approximately 1 millisecond.) This is to be contrasted with a conventional gun when the escaping gas is controlled by the tight fit of bullet to bore, hence most of the gas can expand only at the speed the bullet allows. Thus when the bullet leaves the muzzle of a conventional gun barrel, a massive muzzle blast results due to the high pressure at the muzzle and instantaneous release of propellant gases. The result is that almost all recoil is instantaneously felt at the end of the cycle. Of course, the recoil due to the bullet mass and velocity is not influenced. However, since the recoil of the gas mass and velocity is a large part of the total recoil, the inventive barrel significantly reduces felt recoil.

To understand the firing of the inventive gun barrel 10, a curve has been plotted in FIG. 3 (dotted line curve) which is an approximation of the actual pressure at the base of the bullet versus time. Note that when the projectile enters the expansion section 21, the pressure drops rapidly to about 16,000 psi (pressure indication at station 2) versus a corresponding throat pressure of about 26,000 psi at the same time. As the bullet proceeds to the start of the compression section 22, the pressure at station 3 is slightly lower than the corresponding throat pressure at that time. With the bullet at station 4, the end of the compression section and start of the alignment section 24, the transducer shows a pressure of about 7,500 psi versus a corresponding throat pressure of about 15,000 psi at this time, about 0.7 ms. The bullet then arrives at station 5 at the muzzle at about 0.8 to 0.9 ms, and the pressure is only about 3,300 psi versus a corresponding throat pressure of about 10,000 psi.

Those pressure-time traces show that not only does the throat pressure in the inventive barrel not correspond with pressure further down the barrel, as it does in a conventional barrel, but also that the inventive barrel has a totally different pressure-time trace than a conventional gun. This enables the inventive barrel to achieve the same bullet velocities at lower peak pressures and lower overall pressures, a significant advantage of the invention providing a safer gun with improved accuracy and less felt recoil.

While the invention has been described with reference to a specific embodiment, it will be understood that various changes and modifications may be made within the scope of the invention which is defined by the appended claims.

I claim:

1. A gun barrel for firing a bullet and adapted to be attached to a receiver comprising a cartridge chamber, a rifled section extending from the cartridge chamber for imparting rotation to the bullet, at least some of the riflings in the rifled section being deeper than in a conventional gun barrel to permit propellant gases to expand past the bullet in the rifled section, a smoothbore expansion section extending from the rifled section having a diameter greater than the bullet caliber to permit propellant gases to expand past the bullet and subject the bullet to a forward drag effect, the expanding gases also functioning to evacuate the atmosphere from the gun barrel ahead of the bullet, a smoothbore compression section of decreasing diameter extending from the expansion section to increase the gas flow velocity and thus further accelerate the bullet, and a smoothbore alignment section extending from the compression section and having a diameter less than the bullet caliber to align the bullet on a constant rotational axis to improve accuracy.

2. A gun barrel as defined in claim 1, in which a crown expansion section of increased diameter substantially greater than the bullet caliber extends from the alignment section to protect the exit of the alignment section and to control the gases to be released past the bullet.

3. A gun barrel for firing a bullet and adapted to be attached to a receiver comprising along its length a cartridge chamber, a rifled section, at least some of the riflings in the rifled section being deeper than in a conventional gun barrel to permit propellant gases to expand past the bullet in the rifled section, an expansion section of increased diameter, a compression section of decreasing diameter, the compression section final diameter being less than that of the expansion section, and an alignment section having a diameter less than the bullet caliber, the sections forward of the rifled section being smoothbore to lower bore friction and increase bullet velocity, and the sections being of such diameter that they cooperate to permit propellant gases to expand past the bullet and subject it to a forward drag effect, the expanding gases also functioning to evacuate the atmosphere from the gun barrel ahead of the bullet.

4. A gun barrel as defined in claim 3, in which a crown expansion section of increased diameter substantially greater than the bullet caliber extends from the alignment section to protect the exit of the alignment section and to control the gases to be released past the bullet.

5. A gun barrel for firing a bullet and adapted to be attached to a receiver comprising along its length a cartridge chamber, a rifled section, an expansion section of increased diameter, a compression section of decreasing diameter, the compression section final diameter being less than that of the expansion section, and an alignment section having a diameter less than bullet caliber to align the bullet on a constant rotational axis to improve accuracy, the sections forward of the rifled section being smoothbore to lower bore friction and provide increased bullet velocity, and the smoothbore sections being of such diameter that they cooperate to permit propellant gases to expand past the bullet and subject it to a forward drag effect, the expanding gases also functioning to evacuate the atmosphere from the gun barrel ahead of the bullet, the expansion of the gases past the bullet reducing peak pressure in the barrel and providing relatively low gas pressure adjacent the muzzle at the time of bullet exit compared to the gas pressure adjacent the muzzle in a conventional gun barrel at the time of bullet exit, the reduced peak pressure affording safer gun firing and the low muzzle gas pressure providing reduced bullet deformation and muzzle blast to improve accuracy and reduce felt recoil.

6. A gun barrel as defined in claim 5, in which a crown expansion section of increased diameter substantially greater than the bullet caliber extends from the alignment section to protect the exit of the alignment section and to control the gases to be released past the bullet.

7. A gun barrel as defined in claim 5, wherein at least some of the riflings in the rifled section are deeper than in a conventional gun barrel to permit propellant gases to expand past the bullet in the rifled section and lower peak pressure.

8. A method of providing decreased felt recoil and increased velocity when firing a bullet through a gun barrel comprising the steps of burning a propellant to provide expanding.gases to propel the bullet through a rifled section of the barrel, permitting propellant gases to expand past the bullet in the rifled section and a smoothbore section of the barrel to reduce peak gas pressure in the barrel thus affording safer gun firing, the amount of gases expanding past the bullet being sufficient to provide relatively low gas pressure adjacent the muzzle at the time of bullet exit compared to the gas pressure adjacent the muzzle in a conventional gun barrel, the low gas pressure reducing bullet deformation and muzzle blast, whereby bullet accuracy is increased and felt recoil is reduced.

9. A method of firing a bullet through a gun barrel comprising the steps of providing a gun barrel with a rifled section and smoothbore sections, burning a propellant to provide expanding gases at the entrance of the rifled section to propel a bullet through the section and impart rotation to the bullet, guiding the bullet to a smoothbore increased diameter expansion section to permit the gases to expand past the bullet and subject the bullet to a forward drag effect and evacuate the atmosphere from the gun barrel ahead of the bullet, guiding the bullet to a decreasing diameter smoothbore compression section to increase the gas flow velocity, and guiding the bullet to a smoothbore alignment section having a diameter less than the bullet caliber to align the bullet on a constant rotational axis to improve accuracy, the alignment section being of such diameter that it permits gases to continue to expand past the bullet, the foregoing steps providing relatively low gas pressure adjacent the muzzle at the time of bullet exit in comparison. with the gas pressure adjacent the muzzle in a conventional gun barrel at the time of bullet exit with resulting reduced bullet deformation and muzzle blast, whereby bullet accuracy is increased and felt recoil is reduced.

10. A method as defined in claim 9, wherein significant amounts of the propellant gases are permitted to expand past the bullet in the rifled section to reduce peak gas pressure in the barrel thus affording safer gun firing.

* * * * *